US007097594B2

(12) United States Patent
Lo

(10) Patent No.: US 7,097,594 B2
(45) Date of Patent: Aug. 29, 2006

(54) FOLDING DEVICE FOR TREADMILLS

(76) Inventor: Chiu-Hsiang Lo, No. 20, Lane 305, Sec. 3, Chung-Sun Rd., Tan-Tz Shiang, Taichung Hsien (TW)

( * ) Notice: Subject to any disclaimer, the term of this patent is extended or adjusted under 35 U.S.C. 154(b) by 0 days.

(21) Appl. No.: 11/068,836

(22) Filed: Mar. 2, 2005

(65) Prior Publication Data

US 2006/0148621 A1 Jul. 6, 2006

(30) Foreign Application Priority Data

Dec. 29, 2004 (TW) ..... 93221196 U

(51) Int. Cl.
*A63B 22/02* (2006.01)

(52) U.S. Cl. ..... 482/54

(58) Field of Classification Search ..... 482/51, 482/54

See application file for complete search history.

(56) References Cited

U.S. PATENT DOCUMENTS 5,967,945 A * 10/1999 Wang ..... 482/54
6,726,602 B1 * 4/2004 Chang ..... 482/54
6,811,518 B1 * 11/2004 Lin ..... 482/54
6,884,201 B1 * 4/2005 Wu ..... 482/54
6,923,747 B1 * 8/2005 Chu ..... 482/54

* cited by examiner

*Primary Examiner*—Stephen R. Crow
(74) *Attorney, Agent, or Firm*—Rosenberg, Klein & Lee

(57) ABSTRACT

A treadmill includes a base and a frame having a first end pivotably connected to the base by two parallel first links and two parallel second links. An endless belt is mounted to the frame. Two respective first ends of the two first links are pivotably connected to two respective first pivotal points on the two side rails of the base, and two respective second ends of the two first links are pivotably connected to two respective second pivotal points on two sides of the first end of the frame. Two respective first ends of the two second links are pivotably connected to two respective third pivotal points on the two side rails of the base, and two respective second ends of the two second links are pivotably connected to two respective fourth pivotal points on the two sides of the first end of the frame. The frame can be pivoted relative to the base by the first and second links.

7 Claims, 8 Drawing Sheets

FOLDING DEVICE FOR TREADMILLS

FIELD OF THE INVENTION

The present invention relates to a folding device for folding the frame relative the base of a treadmill.

BACKGROUND OF THE INVENTION

A conventional treadmill generally includes a base, a frame which has one end pivotably connected to the base and an endless belt is connected to the frame. The endless belt can also be driven by a motor so that the users set desired speed of the belt to exercise.

In order to save the space occupied by the treadmill, some treadmills are equipped with a folding device which allows the frame to be pivoted relative to the base. U.S. Pat. No. 6,527,679 discloses a folding mechanism which uses a motor and a threaded rod which is driven by the motor and a connection member pivotably connected to the frame is movably mounted to the threaded rod so that when the threaded rod is rotated by the motor, the connection member pivots the frame. It is noted that the frame is pivotably connected to the base at one point on each of the two sides of the base so that there requires a large angle to pivot the frame relative to the base. Further, another prior art shown in FIG. 8, discloses a similar folding mechanism which is located at the middle portion 51 of the frame 50 so that a less effort is required to pivot the frame 50. However, in order to accommodate the folding mechanism, the frame 50 has to be located at a higher position which makes the treadmill unstable.

The present invention intends to provide a folding device which provides two separated pivotal points on each of two sides of the base for connection with the frame so that the frame can be easily folded relative to the base.

SUMMARY OF THE INVENTION

The present invention relates to a treadmill which comprises a base comprising two side rails and a frame has a first end thereof pivotably connected to the two sides of the base by two parallel first links and two parallel second links. A second end of the frame is a free end. An endless belt is mounted to the frame.

Two respective first ends of the two first links are pivotably connected to two respective first pivotal points the two side rails of the base. Two respective second ends of the two first links are pivotably connected to two respective second pivotal points on two sides of the first end of the frame. Two respective first ends of the two second links are pivotably connected to two respective third pivotal points on the two side rails of the base. Two respective second ends of the two second links are pivotably connected to two respective fourth pivotal points on the two sides of the first end of the frame.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
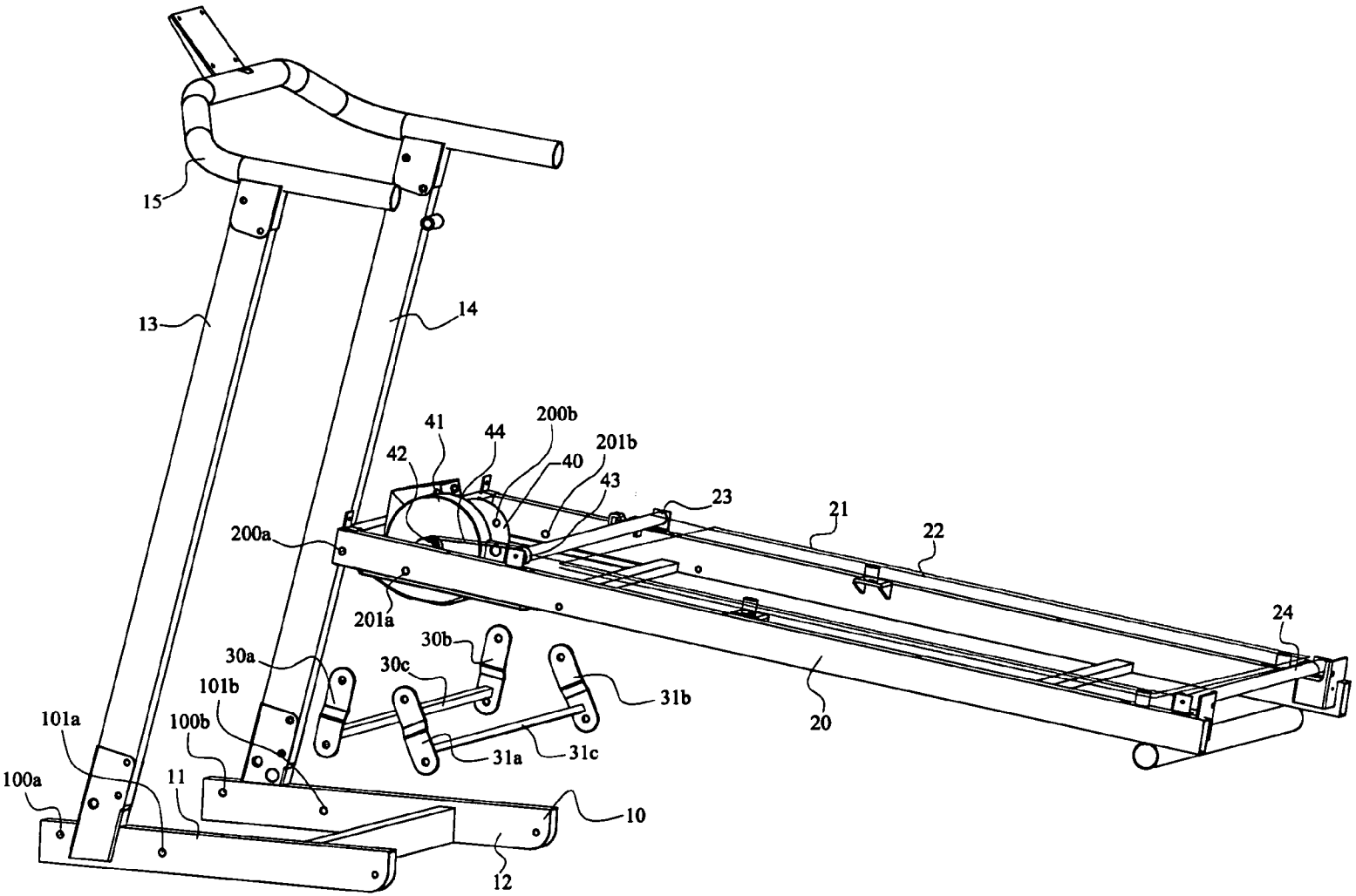
FIG. 1 is an exploded view to show the treadmill and the folding device of the present invention.
Figure 2:
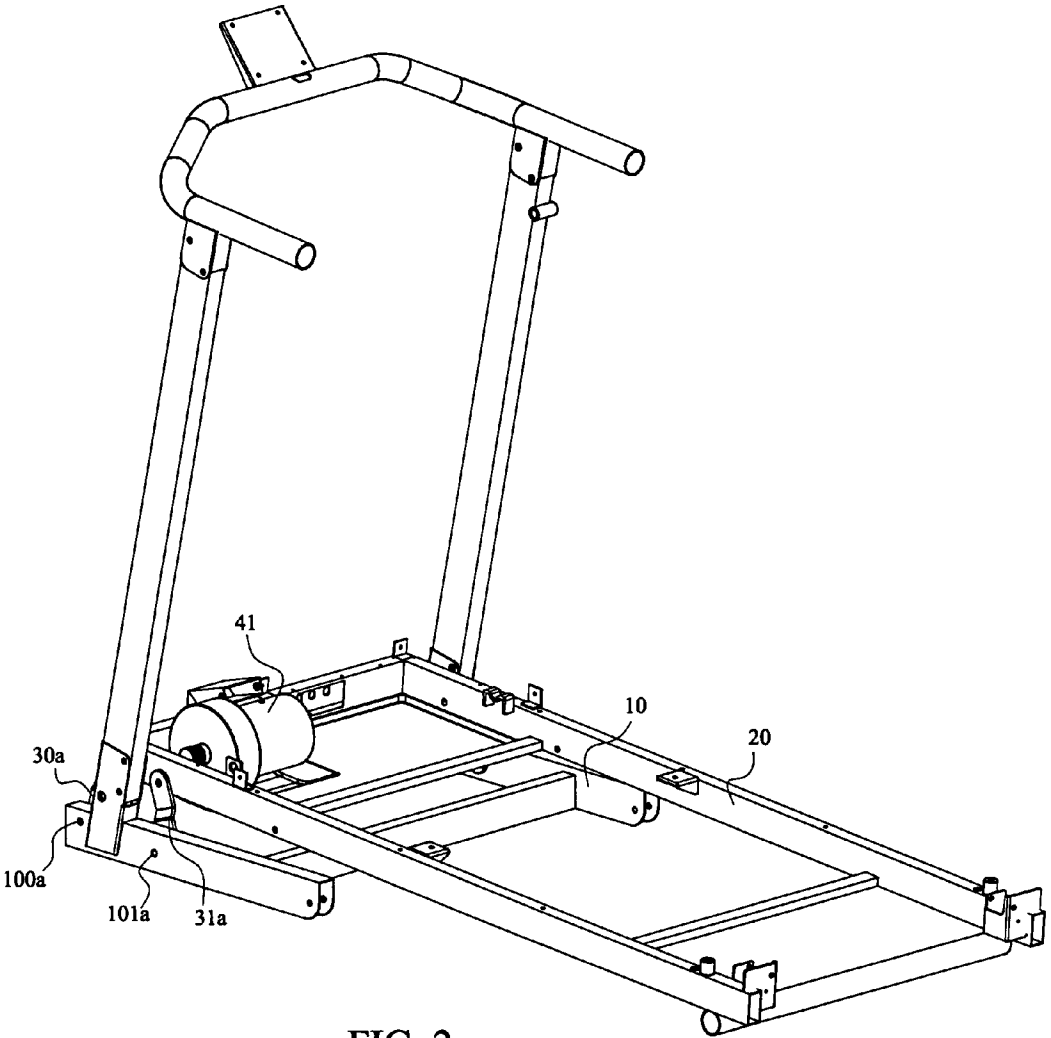
FIG. 2 is a perspective view of the treadmill with the folding device of the present invention.
Figure 3:
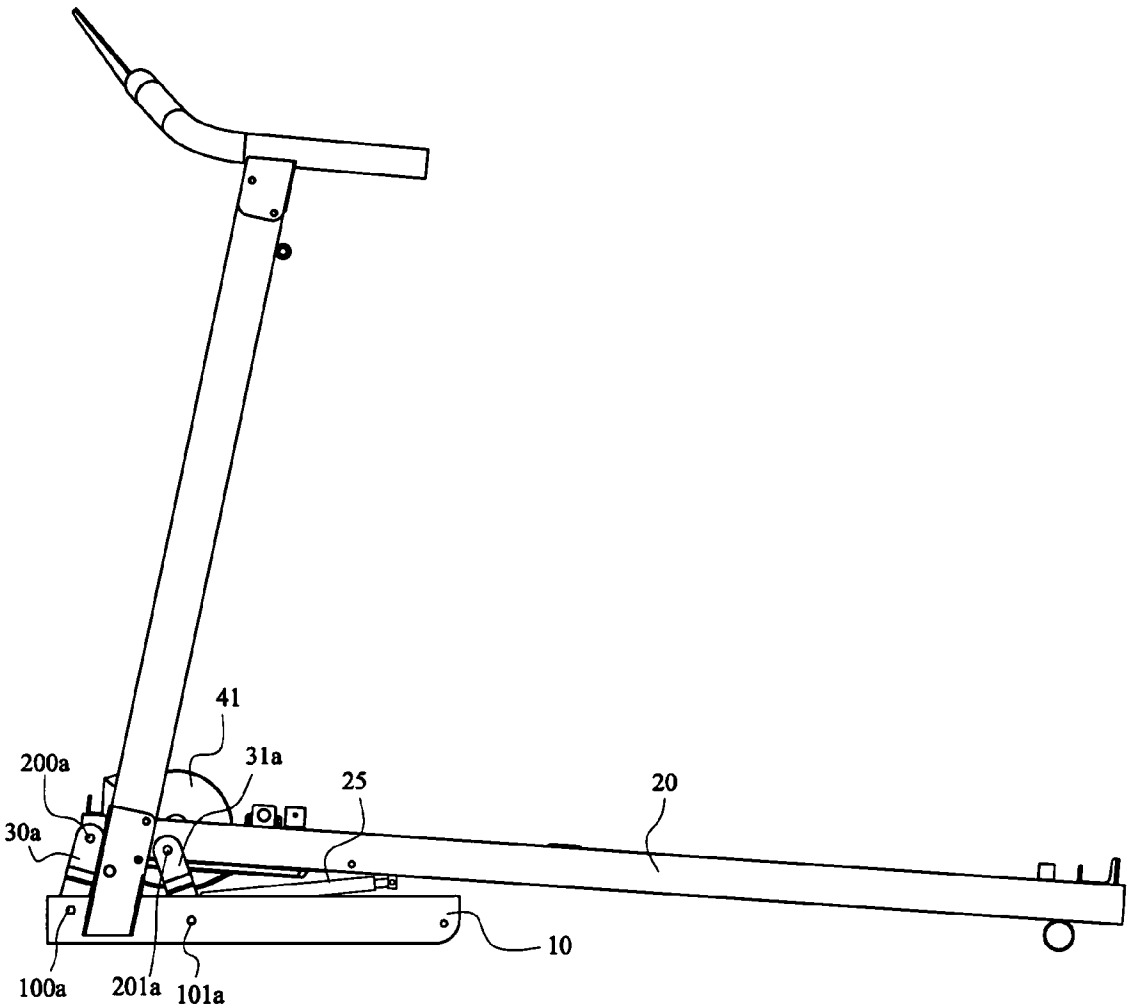
FIG. 3 is a side view to show the treadmill with the folding device of the present invention.
Figure 4:
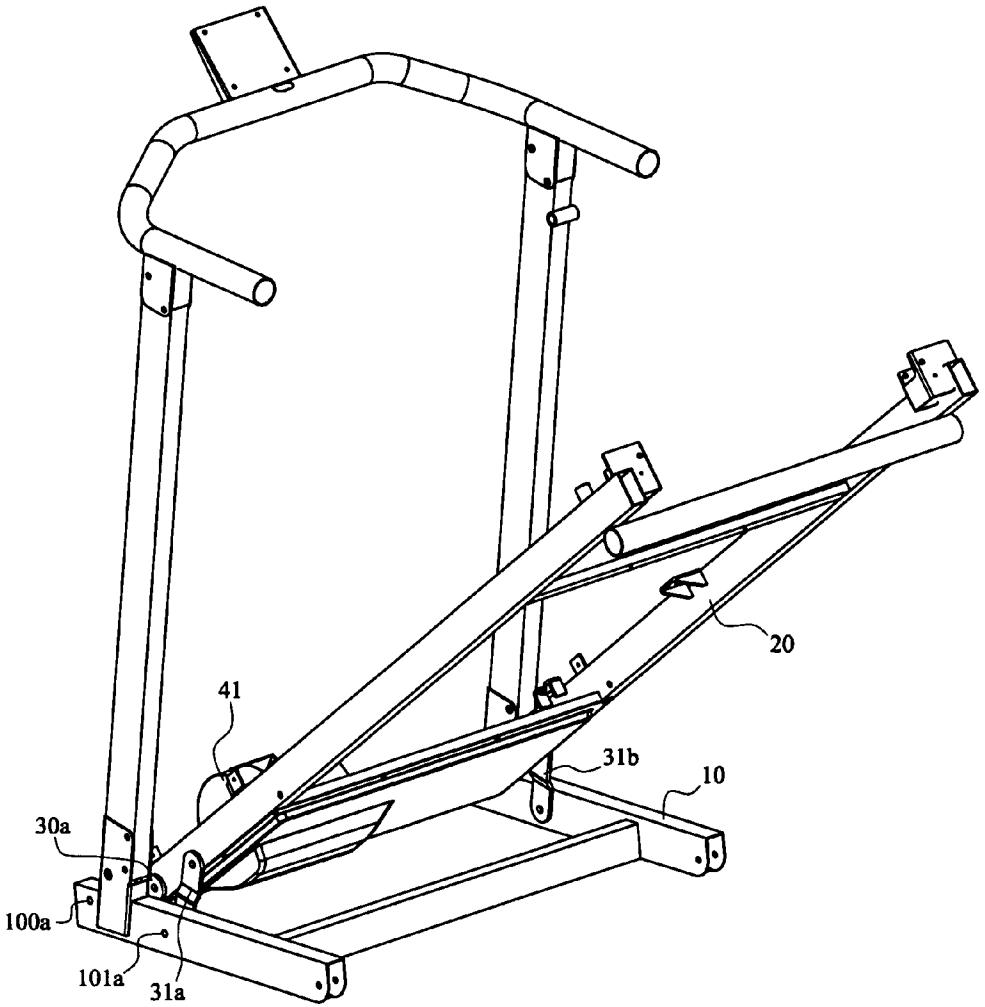
FIG. 4 shows the frame is pivoted relative to the base of the treadmill by the folding device of the present invention.
Figure 5:
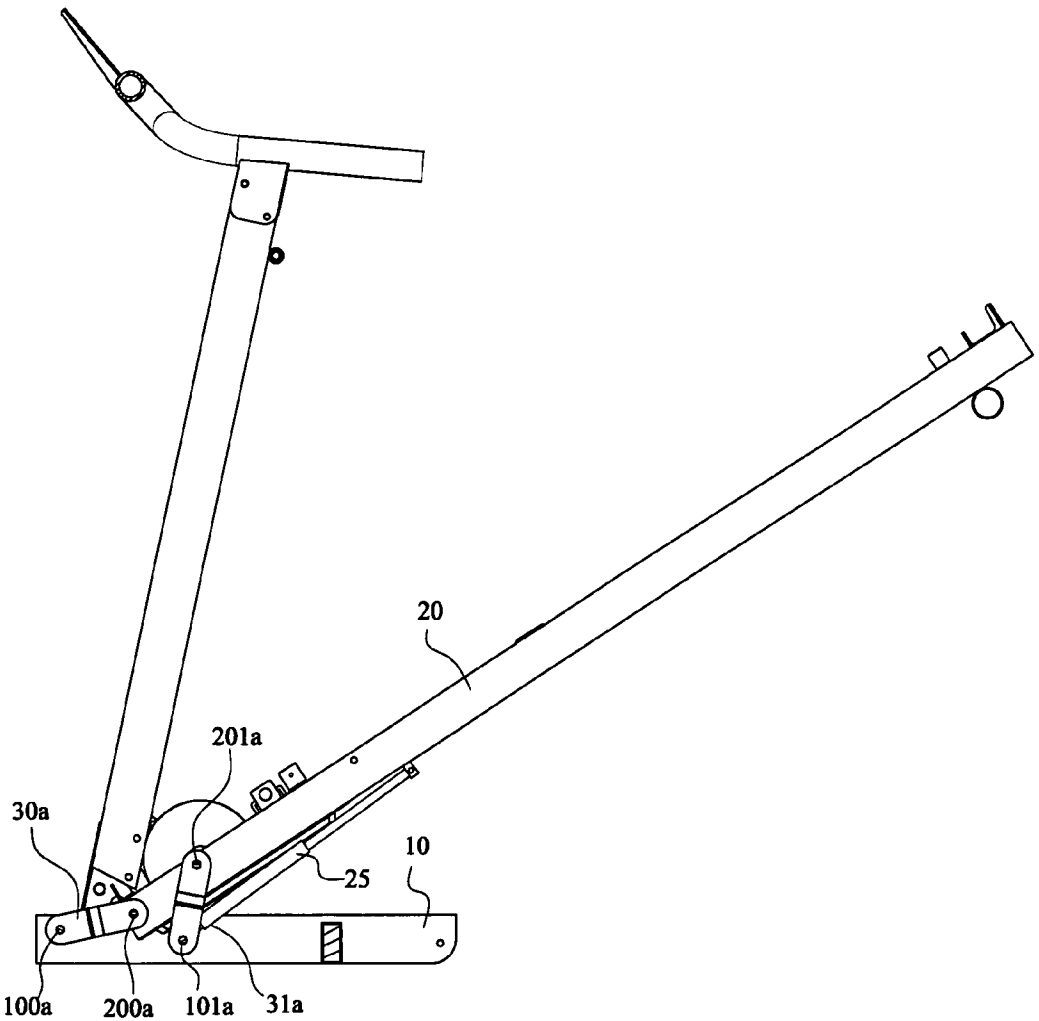
FIG. 5 is a side view to show the frame is pivoted relative to the base.

Referring to FIGS. 1 to 3, the treadmill of the present invention comprises a base 10 comprising two side rails 11, 12 and two posts 13, 14 extend from the two side rails 11, 12. A U-shaped handle 15 is connected between the two posts 13, 14.

A frame 20 has a first end and a second end which is a free end.

An endless belt 21 is mounted to the frame 20.

Two parallel first links 30*a*, 30*b* and two parallel second links 31*a*, 31*b*. Two respective first ends of the two first links 30*a*, 30*b* are pivotably connected to two respective first pivotal points 100*a*, 100*b* on the two side rails 11, 12 of the base 10. Two respective second ends of the two first links 30*a*, 30*b* are pivotably connected to two respective second pivotal points 200*a*, 200*b* on two sides of the first end of the frame 20. Two respective first ends of the two second links 31*a*, 31*b* are pivotably connected to two respective third pivotal points 101*a*, 101*b* on the two side rails 11, 12 of the base 10. Two respective second ends of the two second links 31*a*, 31*b* are pivotably connected to two respective fourth pivotal points 201*a*, 201*b* on the two sides of the first end of the frame 20. When in use, the frame 20 is put on the floor at an angle by the links 30*a*, 30*b*, 31*a*, 31*b*, and when not in use, the frame 20 can be pivoted relative to the base 10 By the first and second links 30*a*, 30*b*, 31*a* and 31*b*.

A first rod 30*c* is connected between the two first links 30*a*, 30*b* and a second rod 31*c* is connected between the two second links 31*a*, 31*b*. Therefore, the two first links 30*a*, 30*b* and the two second links 31*a*, 31*b* are co-rotated. The first rod 30*c* and the second rod 31*c* reinforce the four links 30*a*, 30*b*, 31*a*, 31*b* to support the frame 20.

A pushing device 25 such as a pneumatic cylinder, is connected between the base 10 and the frame 20 so as to pivot the frame 20 relative to the base 10. In detail, one end of the pushing device 25 is pivotably connected to the frame 20 and the other end of the pushing device 25 is pivotably connected to one of the first and second links 30*a*, 30*b*, 31*a*, 31*b*. By the pushing device 25, the pivoting action of the frame 20 is easily.

A support deck 22 is connected on the frame 20 and two pairs of rollers 23, 24 are connected on the two sides of the frame 20 and located corresponding to two ends of the support deck 22. The endless belt 21 reeves through the two pairs of rollers 23, 24 and the support deck 22 located beneath an upper portion of the endless belt 21 so as to support the load of the users.

A driving device 40 is located between the two side rails of the base 10 so as to drive one of the rollers 23, 24 to drive the endless belt 21.

The driving device 40 includes a motor 41 which has a first pulley 42 and a second pulley 43 is connected to the roller 23, 24 which is driven by the motor 41. A transmission belt 44 reeves through the first and second pulleys 42, 43 such that the power of the driving device 40 is transferred to the roller 23, 24 having the second pulley 43.

Figure 6:
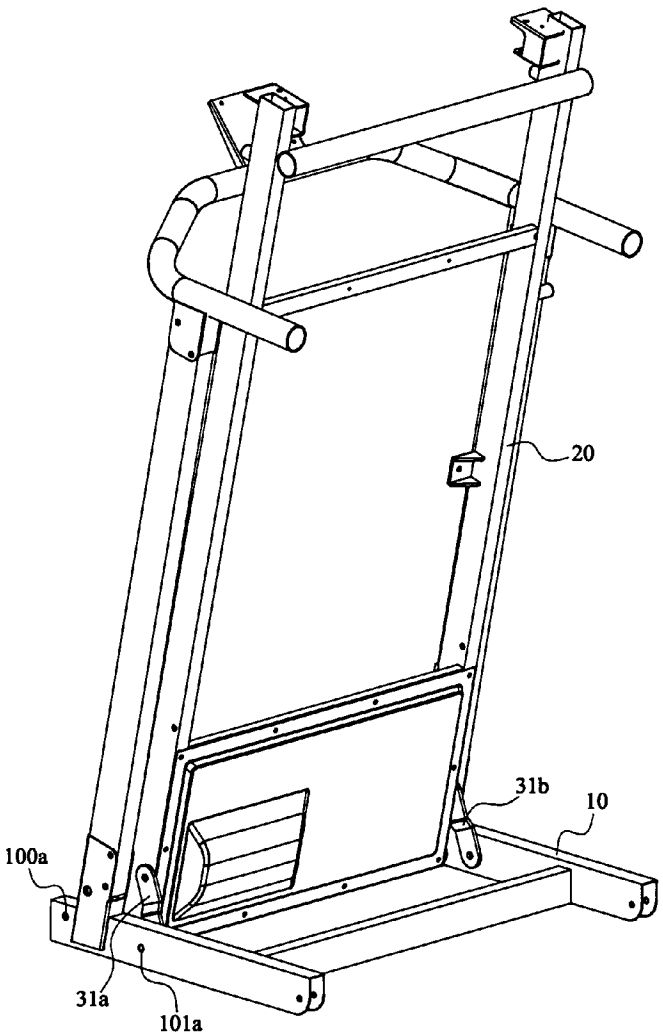
FIG. 6 shows that the frame is pivoted to its final position.
Figure 7:
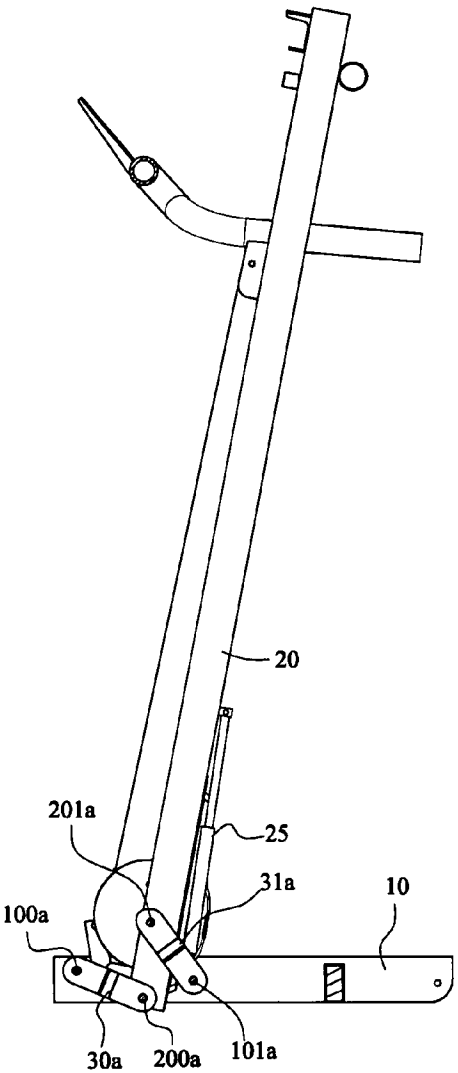
FIG. 7 is a side view of the status of the treadmill in FIG. 6.
Figure 8:
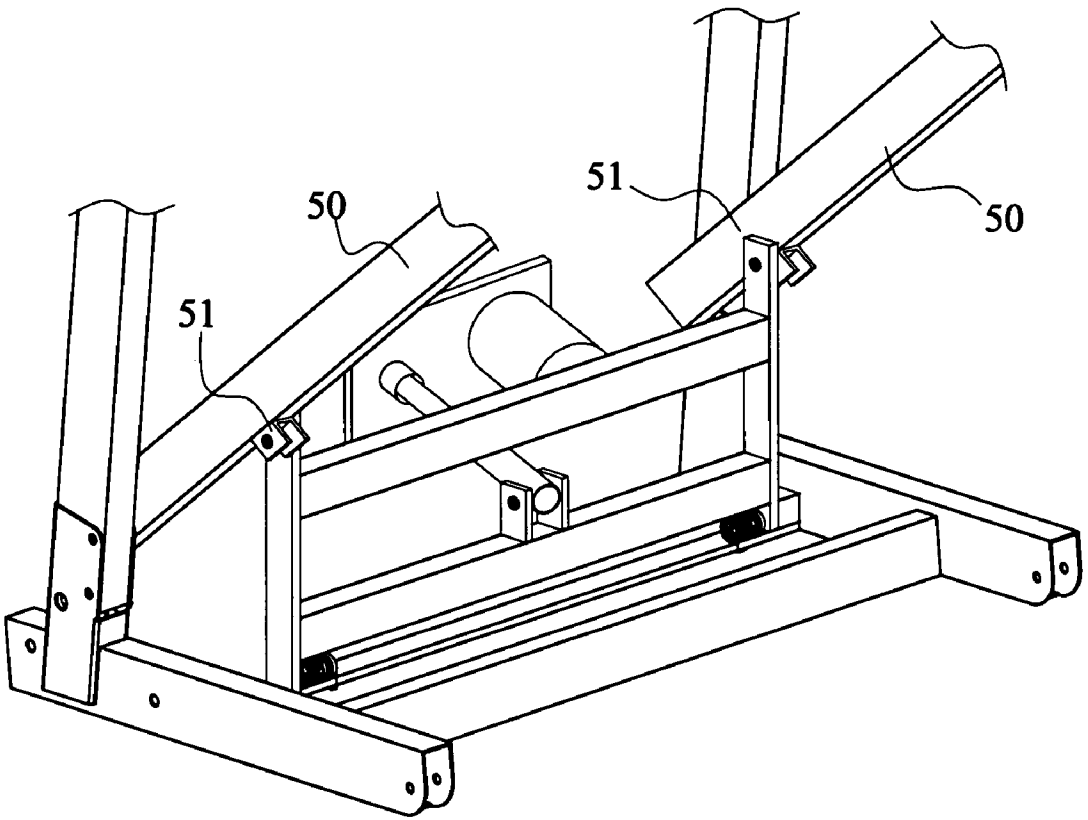
PRIOR ART FIG. 8
FIG. 8 shows the frame is pivoted relative to the base of the treadmill by the folding device of a prior art.

Referring to FIGS. 4 to 7, when folding the frame 20, the user may lifts the second end of the frame 20 to pivot the frame 20 relative to the base 10 till the frame 20 reaches its final position as shown in FIGS. 6 and 7.

While we have shown and described the embodiment in accordance with the present invention, it should be clear to those skilled in the art that further embodiments may be made without departing from the scope of the present invention.

What is claimed is:

1. A treadmill comprising:

a base comprising two side rails;

a frame having a first end and a second end which is a free end;

an endless belt mounted to the frame;

two parallel first links and two parallel second links, two respective first ends of the two first links pivotably connected to two respective first pivotal points on the two side rails of the base, two respective second ends of the two first links pivotably connected to two respective second pivotal points on two sides of the first end of the frame, and two respective first ends of the two second links pivotably connected to two respective third pivotal points on the two side rails of the base, two respective second ends of the two second links pivotably connected to two respective fourth pivotal points on the two sides of the first end of the frame, the frame being capable of pivoting relative to the base by the first and second links.

2. The treadmill as claimed in claim 1, wherein a first rod is connected between the two first links and a second rod is connected between the two second links.

3. The treadmill as claimed in claim 1, wherein a pushing device is connected between the base and the frame so as to pivot the frame relative to the base.

4. The treadmill as claimed in claim 1, wherein a pushing device is connected between the base and the frame so as to pivot the frame relative to the base, one end of the pushing device is pivotably connected to the frame and the other end of the pushing device is pivotably connected to one of the first and second links.

5. The treadmill as claimed in claim 1, wherein a support deck is connected on the frame and two pairs of rollers are connected on the two sides of the frame and located corresponding to two ends of the support deck, the endless belt reeves through the two pairs of rollers and the support deck located beneath an upper portion of the endless belt.

6. The treadmill as claimed in claim 5 further comprising a driving device which drives one of the rollers so as to drive the endless belt.

7. The treadmill as claimed in claim 6, wherein the driving device includes a motor which has a first pulley, a second pulley is connected to the roller that is driven by the motor, a transmission belt reeves through the first and second pulleys.

* * * * *